United States Patent [19]

Bartel et al.

[11] Patent Number: 4,941,694

[45] Date of Patent: Jul. 17, 1990

[54] POWER ACTUATOR FOR MOTOR-VEHICLE CENTRAL LOCK SYSTEM

[75] Inventors: Peter Bartel, Hattingen; Rolf Schüler, Heiligenhaus, both of Fed. Rep. of Germany

[73] Assignee: Kiekert GmbH & Co. Kommanditgesellschaft, Heiligenhaus, Fed. Rep. of Germany

[21] Appl. No.: 343,584

[22] Filed: Apr. 25, 1989

[30] Foreign Application Priority Data

Jul. 12, 1988 [DE] Fed. Rep. of Germany ..... 3823505

[51] Int. Cl.[5] ..... E05B 47/00

[52] U.S. Cl. ..... 292/201; 292/336.3

[58] Field of Search ..... 292/201, 336.3, 252; 74/584, 89.15

[56] References Cited

U.S. PATENT DOCUMENTS

| | | | |
|---|---|---|---|
| 4,342,209 | 8/1982 | Kleefeldt | 70/264 |
| 4,647,089 | 3/1987 | Zangrando | 292/144 |
| 4,669,283 | 6/1987 | Ingenhoven | 70/264 |
| 4,885,922 | 12/1989 | Lutz | 292/201 X |

*Primary Examiner*—Richard E. Moore

*Attorney, Agent, or Firm*—Herbert Dubno; Andrew Wilford

[57] ABSTRACT

A power actuator used with a door latch has a housing fixed adjacent the latch and a slide linked to the latch and displaceable along an axis in the housing between locked and unlocked positions respectively corresponding to the locked and unlocked conditions of the latch. This slide is formed with a radially elastically deflectable entrainment formation and with a crosspiece. An axial spindle carries a nut engageable with the entrainment formation and the crosspiece of the slide. A radially elastically deflectable locking dog axially fixed to the slide is also engageable with the nut and the housing is formed with a radially inwardly open recess in which the dog is engageable only in the locked position of the slide. An electric motor can rotate the spindle and thereby displace the nut from an antitheft end position through an intermediate position and into an end locked position. In the antitheft position the nut engages the crosspiece and the dog, presses the dog into the recess, and positively retains the slide in the locked position. In the intermediate position the nut engages the entrainment formation of the nut in the locked position of the slide and out of engagement with the dog. In the end locked position the nut engages the entrainment formation of the nut in the unlocked position of the slide. The slide is displaceable between its unlocked and locked positions in the unlocked end position of the nut by elastic deflection of the entrainment formation.

8 Claims, 1 Drawing Sheet

POWER ACTUATOR FOR MOTOR-VEHICLE CENTRAL LOCK SYSTEM

FIELD OF THE INVENTION

The present invention relates to a motor-vehicle central lock system. More particularly this invention concerns a power actuator for such a system.

BACKGROUND OF THE INVENTION

A standard central motor-vehicle lock system has a plurality of door latches on the individual doors, hatches, trunk lids, and the like that are each operable by a respective power actuator and also by a manual mechanism. The power actuator can include a hydraulic, pneumatic, or electric motor, and the manual mechanism is almost always a lever linkage. All of the actuators can be operated centrally, normally from the driver's seat or door, to lock and unlock the doors.

It has become common to provide such a central locking system with a so-called antitheft feature. When set in the antitheft mode it is impossible to unlock the vehicle doors even by manual actuation of the latches. Thus a person who breaks a window or otherwise gains forcible entry to the vehicle cannot open its doors.

Such a system as described in my earlier U.S. Pat. No. 4,669,283 uses an actuator constituted as a housing in which is displaceable a slide connected to the respective inside door-locking element, normally a knob. This slide in turn is displaced by means of a nut which rides on a threaded spindle rotated by the respective motor. The slide is displaceable between an unlocked, a locked, and an antitheft position. The nut engages a deflectable part of the slide to displace it into the locked and unlocked positions so that when in these positions the setting can be manually overridden. On the other hand, the nut positively engages a wall of the slide in the antitheft position. The gear train driving the spindle, the types of threads employed between the nut and the spindle, or similar means are employed to make it impossible to move the slide when thus held in the antitheft position without actually destroying the actuator. Clearly such an arrangement requires that the actuator be made very strong in order to give the greatest level of security. This requires typically that very robust parts be used, thereby increasing the size, weight, and cost of the assembly, or that binding-type threads be employed between the spindle and nut so that a relatively strong motor be used or a relatively slot actuation must be allowed for.

In another known arrangement described in commonly owned U.S. Pat. No. 4,342,209 a separate latch dog is employed on the slide that engages in a keeper in the housing of the actuator in the antitheft position. Such an arrangement is relatively secure, but once again is fairly complex and expensive to manufacture.

OBJECTS OF THE INVENTION

It is therefore an object of the present invention to provide an improved actuator for a motor-vehicle central lock system.

Another object is the provision of such an improved actuator for a motor-vehicle central lock system which overcomes the above-given disadvantages, that is which solidly holds the slide in the antitheft position but that can be built inexpensively, preferably of synthetic-resin parts.

SUMMARY OF THE INVENTION

The instant invention is a power actuator used in combination with a door latch actuatable between a locked and an unlocked condition. The actuator has a housing fixed adjacent the latch and a slide linked to the latch and displaceable along an axis in the housing between locked and unlocked positions respectively corresponding to the locked and unlocked conditions of the latch. This slide is formed with a radially elastically deflectable entrainment formation and with a crosspiece. A spindle extending along the axis carries a nut engageable with the entrainment formation and the crosspiece of the slide. A radially elastically deflectable locking dog axially fixed to the slide is also engageable with the nut and the housing is formed with a radially inwardly open recess in which the dog is engageable only in the locked position of the slide. An electric motor connected to the spindle can rotate same and thereby displace the nut from an antitheft end position through an intermediate position and into an end locked position. In the antitheft position the nut engages the crosspiece and the dog, presses the dog into the recess, and positively retains the slide in the locked position. In the intermediate position the nut engages the entrainment formation of the nut in the locked position of the slide and out of engagement with the dog. In the end locked position the nut engages the entrainment formation of the nut in the unlocked position of the slide. The slide is displaceable between its unlocked and locked positions in the unlocked end position of the nut by elastic deflection of the entrainment formation.

Thus with this arrangement a simply constructed slide is positively locked in the antitheft position so that even if an attempt is made to force the lock, virtually no stress will be applied to the connection between the nut and spindle. It is therefore possible to provide the nut and spindle with interengaging screwthreads of the nonbinding square-drive type so that a very low-power motor can be used to operate the actuator. In addition it is possible to use a relatively steep screwthread so that the actuator will operate relatively quickly. Virtually the entire actuator can be made of a durable synthetic resin so that it will be light, easy to manufacture, and have a long service life.

According to another feature of this invention the slide is provided with an elastically deflectable finger extending generally axially and having one end attached to the slide and another end carrying the dog. This finger can be integrally formed of the same synthetic-resin as the slide or can be an inset metal piece. In either case in accordance with this invention it is also formed with the entrainment formation, typically constituted as a simple bump.

Both the entrainment bump and the dog, which project radially oppositely from the finger and which are axially offset from each other, are engageable with the same engagement formation of the nut. This latter formation is typically also formed as a simple radially outwardly projecting bump. Normally two such fingers are provided for symmetrical holding of the slide.

DESCRIPTION OF THE DRAWING

The above and other objects, features, and advantages will become more readily apparent from the following, reference being made to the accompanying drawing in which.

SPECIFIC DESCRIPTION

Figure 1:
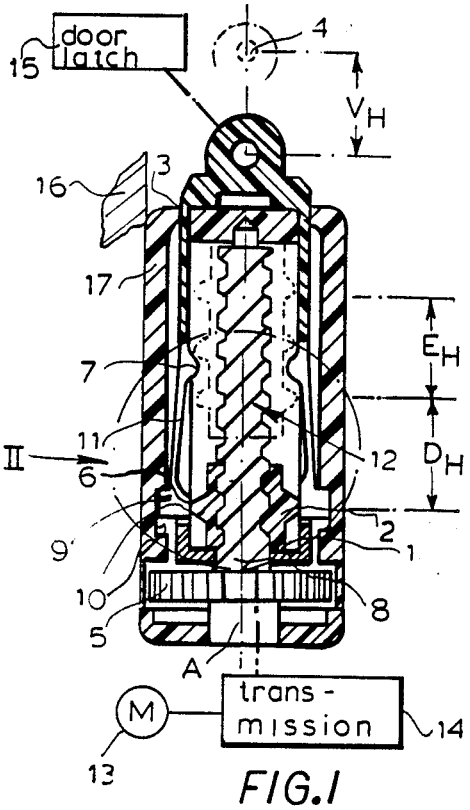
FIG. 1 is a partly schematic axial section through the actuator according to this invention.

As seen in FIG. 1 a central lock system of the type generally described in above-mentioned U.S. Pat. No. 4,669,283 has a motor 13 connected via a transmission 14, typically a simple worm, to a gear 5 carried on a spindle 1 rotatable about an axis A in a housing 17 fixed as shown schematically at 16 inside a motor vehicle. The spindle 1 has a nonbinding screwthread 12 by means of which it carries a complementary shaped nut 2 that is inhibited from rotating in the housing 17 and that rides inside a slide 3 connected via an actuating rod 4 to the locking lever 4 of a door latch shown schematically at 15 and of the type described in above-cited U.S. Pat. No. 4,342,209.

The slide 3 is formed with a pair of outwardly deflectable entrainment formations or bumps 7 engageable by actuating formations or bumps 6 on the nut 2. In addition the slide 3 is provided with a pair of metallic inset fingers or tabs 11 having upper ends seated on the slide 3 and forming the bumps 5 and lower ends forming dogs 9 that can engage in recesses or seats 10 in the side wall of the housing 17 in the illustrated fully retracted position of the slide 3.

Figure 2:
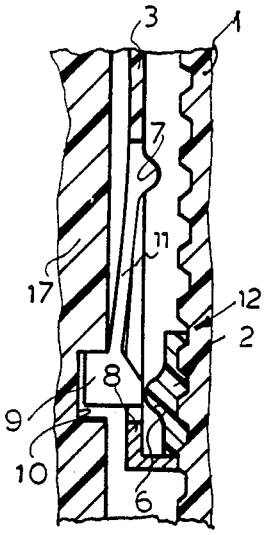
FIG. 2 is a large-scale view of the detail indicated at II in FIG. 1.

Thus in the position of FIGS. 1 and 2, which is the antitheft position, the nut 2 solidly abuts an end wall 8 of the slide 3 and the dogs or tabs 9 are pressed into the recesses 10. In this position the slide 3 is positively locked by the interfit of the formations 9 and 10 from moving axially in the housing 17. It is therefore possible to use a relatively steep screwthread 12 of the nonbinding type since even if considerable axial force is exerted on the slide 3 there will be no force effective on the nut 2 to reverse-rotate it.

Figure 3:
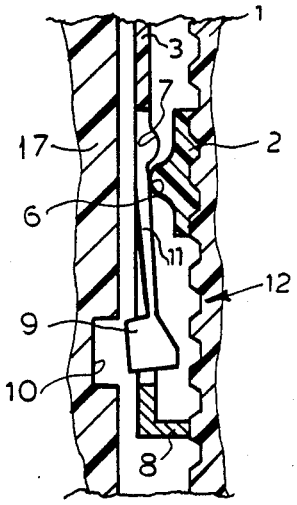
FIG. 3 is a view like FIG. 2 but showing the parts in the locked antitheft position.

From this antitheft position the spindle 1 can screw the nut 2 up through a stroke $D_H$ until it just engages the undersides of the bumps 7. As soon as the bumps 6 move up past the dogs 9 these elements spring elastically inward as shown in FIG. 3 to clear the seats 10. Thus when the nut 2 is at the upper end of its stroke $D_H$ the slide 3 can be moved upward to unlock the door, trunk, or the like, that is it is possible to manually unlock the door.

Displacement of the nut 2 from the intermediate position at the upper end of the stroke $D_H$ through a further stroke $E_H$ causes the bumps 6 to engage the bumps 7 and push the entire slide 3 up through a stroke $V_H$. This action unlocks the respective latch 15. When in the upper position at the outer end of the stroke $E_H$ it is, however, possible to manually lock the latch 15 since a forcible downward push on the slide 3 via the rod 4 will simply push the bumps 7 downward over the bumps 6, with elastic outward deflection of these bumps 7. Thus once the door has been unlocked centrally it can be individually relocked manually.

Locking the door centrally is the reverse of the above-described sequence of steps: As the nut 2 moves downward through the stroke $E_H$ it will pull down the slide 3 and lock the door. Further displacement down through the stroke $D_H$ will cause the nut to bottom on the end wall 8 and simultaneously push out the dogs 9, effectively locking the slide 3 in the housing 17.

We claim:

1. In combination with a door latch actuatable between a locked and an unlocked condition, a power actuator comprising:

a housing fixed adjacent the latch;

a slide linked to the latch and displaceable along an axis in the housing between locked and unlocked positions respectively corresponding to the locked and unlocked conditions of the latch, the slide being formed with a radially elastically deflectable entrainment formation and with a crosspiece;

a spindle extending along the axis;

a nut carried on the spindle and engageable with the entrainment formation and the crosspiece of the slide;

a radially elastically deflectable locking dog axially fixed to the slide and engageable with the nut, the housing being formed with a radially inwardly open recess in which the dog is engageable only in the locked position of the slide; and drive means including an electric motor connected to the spindle for rotating same and thereby displacing the nut from an antitheft end position engaging the crosspiece and the dog, pressing the dog into the recess, and positively retaining the slide in the locked position, through an intermediate position engaging the entrainment formation of the nut in the locked position of the slide and out of engagement with the dog, and into an unlocked end position engaging the entrainment formation of the nut in the unlocked position of the slide, the slide being displaceable between its unlocked and locked positions in the unlocked end position of the nut by elastic deflection of the entrainment formation.

2. The power actuator defined in claim 1 wherein the slide is provided with an elastically deflectable finger extending generally axially and having one end attached to the slide and another end carrying the dog.

3. The power actuator defined in claim 2 wherein the finger also carries offset from the dog the entrainment formation.

4. The power actuator defined in claim 1 wherein the nut and spindle are formed with interengaging nonbinding-type screwthreads.

5. The power actuator defined in claim 1 wherein the nut has an engagement formation engageable with both the entrainment formation and the dog for radially deflecting same.

6. The power actuator defined in claim 1 wherein the slide is formed unitarily with an elastically deflectable finger extending generally axially and having one end attached to the slide and another end carrying the dog.

7. The power actuator defined in claim 1 wherein the slide is formed of a synthetic resin and is provided with an elastically deflectable metallic finger extending generally axially and having one end attached to the slide and another end carrying the dog.

8. The power actuator defined in claim 1 wherein the slide is provided with an elastically deflectable finger extending generally axially, having one end attached to the slide and another end carrying the dog, and normally in a position with the dog radially inward of the recess.

* * * * *